US009950543B2

(12) United States Patent
Kim et al.

(10) Patent No.: US 9,950,543 B2
(45) Date of Patent: Apr. 24, 2018

(54) CARTRIDGE FOR RECORDING MEDIUM AND IMAGE FORMING APPARATUS HAVING THE SAME

(71) Applicant: S-PRINTING SOLUTION CO., LTD., Suwon-si, Gyeonggi-do (KR)

(72) Inventors: Hyun-Woo Kim, Suwon-si (KR); Yu Jin Oh, Anyang-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/266,619

(22) Filed: Sep. 15, 2016

(65) Prior Publication Data

US 2017/0197440 A1 Jul. 13, 2017

(30) Foreign Application Priority Data

Jan. 12, 2016 (KR) ..... 10-2016-0003955

(51) Int. Cl.

| | |
|---|---|
| ***B41J 11/00*** | (2006.01) |
| ***B41J 13/10*** | (2006.01) |
| ***B41J 15/04*** | (2006.01) |
| *B41J 2/32* | (2006.01) |

(52) U.S. Cl.

CPC ..... *B41J 11/0005* (2013.01); *B41J 13/10* (2013.01); *B41J 15/042* (2013.01); *B41J 15/044* (2013.01); *B41J 2/32* (2013.01)

(58) Field of Classification Search

CPC ..... B41J 13/10; B41J 15/042; B41J 15/044; B41J 11/0005

See application file for complete search history.

(56) References Cited

U.S. PATENT DOCUMENTS

2011/0012978 A1* 1/2011 Kawashima ..... B41J 2/32 347/218

FOREIGN PATENT DOCUMENTS

| | | |
|---|---|---|
| JP | 2005-107081 | 4/2005 |
| KR | 10-2013-0044832 | 5/2013 |
| KR | 10-1297646 | 8/2013 |

* cited by examiner

*Primary Examiner* — Lamson Nguyen
(74) *Attorney, Agent, or Firm* — Staas & Halsey LLP

(57) ABSTRACT

A cartridge for a recording medium and an image forming apparatus are provided. The image forming apparatus includes a housing, a printing unit disposed inside the housing, and having a thermal head with a heating element, and a cartridge for a recording medium, in which a recording medium wound in a roll shape is installed and which is provided to supply the recording medium to the printing unit, wherein the cartridge for a recording medium has a de-curl roller which guides the recording medium to be curved in a direction opposite to a winding direction, and is provided to be movable in a direction adjacent to the recording medium when the recording medium is supplied to the printing unit.

18 Claims, 17 Drawing Sheets

CARTRIDGE FOR RECORDING MEDIUM AND IMAGE FORMING APPARATUS HAVING THE SAME

CROSS-REFERENCE TO RELATED APPLICATIONS

This application claims the priority benefit of Korean Patent Application No. 10-2016-0003955, filed on Jan. 12, 2016 in the Korean Intellectual Property Office, the disclosure of which is incorporated herein by reference.

BACKGROUND

1. Field

Embodiments of the present disclosure relate to an image forming apparatus, and more particularly, to an image forming apparatus which outputs a recording medium having an adhesive property.

2. Description of the Related Art

In living of daily life, studying or working, an adhesive recording medium which can be repeatedly attached and detached may be used to remember important content.

In the related art, the adhesive recording medium was used in a method in which a user directly writes desired content on the recording medium. In this case, there was a problem that the content, such as an image, a chart, a graph, a symbol, a figure and a picture which are difficult to be expressed by the writing method, is difficult to be recorded on the adhesive recording medium.

Meanwhile, an image forming apparatus, such as a printer, a facsimile and a copy machine, prints an image on the recording medium through a printing head. The image forming apparatus may be classified into various types such as a dot type, an inkjet type, a laser type, a thermal transfer type and a thermal type.

The thermal type image forming apparatus has a thermal head for selectively heating a plurality of heating elements, and the thermal head is in direct contact with a thermal recording medium, and applies heat to the recording medium, and thus printing is performed.

Only thermal paper should be used in the thermal type image forming apparatus. But there are some advantages that an ink or a toner is not required, and due to a simple printing principle, it can be miniaturized and portable, and also it has a low price.

SUMMARY

Additional aspects and/or advantages will be set forth in part in the description which follows and, in part, will be apparent from the description, or may be learned by practice of the invention.

Therefore, it is an aspect of the present disclosure to provide an image forming apparatus which prevents a printed image from being diagonally formed on a recording medium as the recording medium is diagonally conveyed when being conveyed.

It is another aspect of the present disclosure to provide an image forming apparatus which prevents a recording medium from being damaged as the recording medium is diagonally conveyed when being conveyed.

It is still another aspect of the present disclosure to provide an image forming apparatus having a de-curl roller for correcting a curl of a recording medium.

Additional aspects of the disclosure will be set forth in part in the description which follows and, in part, will be obvious from the description, or may be learned by practice of the disclosure.

In accordance with an aspect of the present disclosure, a cartridge for a recording medium includes a cartridge case including a recording medium supporting portion which fixes a position of a center of the recording medium wound in a roll shape and rotatably fixes the recording medium; and a de-curl roller configured to guide the recording medium to be curved in a direction opposite to a winding direction, and movably coupled to the cartridge case.

The de-curl roller may be provided to be moved in a direction which approaches the recording medium as a radius of the wound recording medium is reduced.

The cartridge case may include a de-curl roller guiding portion into which the de-curl roller is movably inserted and which is formed to guide movement of the de-curl roller.

The de-curl roller may be provided to be movable in a direction adjacent to the recording medium or a direction spaced apart from the recording medium to maintain a contact state with an outer circumferential surface of the recording medium.

In accordance with an aspect of the present disclosure, an image forming apparatus includes a housing; a printing unit disposed inside the housing, and having a thermal head with a heating element; and a cartridge for a recording medium in which the recording medium wound in a roll shape is installed and which is provided to supply he recording medium to the printing unit, wherein the cartridge for a recording medium has a de-curl roller which guides the recording medium to be curved in a direction opposite to a winding direction and is provided to be movable in a direction adjacent to the recording medium when the recording medium is supplied to the printing unit.

The housing may include a conveying unit which conveys the recording medium supplied from the cartridge for a recording medium, and the de-curl roller may be provided so that an angle with respect to the conveying unit based on a rotating center of the recording medium is 90° or more and 140° or less.

The cartridge for a recording medium may include a cartridge fixing portion formed to be fixed to the housing.

The housing may include a cartridge accommodating portion into which the cartridge fixing portion is inserted, and the cartridge fixing portion may include a cylindrical pillar-shaped protrusion or a polyprism-shaped protrusion inserted into the cartridge accommodating portion.

The cartridge fixing portion may include a housing hooking groove hook-coupled to the housing.

The housing may include a lower housing having a first conveying roller which conveys the recording medium supplied from the cartridge for a recording medium; and an upper housing which opens and closes an upper surface of the lower housing and has a second conveying roller for conveying the recording medium together with the first conveying roller, wherein the second conveying roller may be disposed to form a conveying nip together with the first conveying roller when the upper housing closes the upper surface of the lower housing.

The housing may include a lower housing and an upper housing provided to open and close an upper surface of the lower housing, the printing unit may include a platen roller which forms a printing nip together with the thermal head and is provided in the upper housing, and the platen roller may form the printing nip together with the thermal head when the upper housing closes the upper surface of the lower housing.

The printing unit may include a conveying motor which is disposed in the lower housing and generates power for driving the platen roller, and the platen roller may be disposed to be connected to the conveying motor to receive the power when the upper housing closes the upper surface of the lower housing.

The cartridge for a recording medium may include a de-curl roller guiding portion into which the de-curl roller is movably inserted and which is formed to guide movement of the de-curl roller.

The de-curl roller may be provided to be movable in a direction adjacent to the recording medium or a direction spaced apart from the recording medium to maintain a contact state with an outer circumferential surface of the recording medium.

The de-curl roller may be configured to be moved in a direction adjacent to the recording medium by a weight of the de-curl roller itself or a force for conveying the recording medium.

At least a part of one surface of the recording medium may be provided to have an adhesive property.

The cartridge for a recording medium may include a recording medium supporting portion which fixes a position of a rotating center of the recording medium to be rotatable.

The cartridge for a recording medium may include a cartridge case which is provided to cover the recording medium and has an opening for supplying the recording medium to the printing unit.

The cartridge for a recording medium may include a recording medium supporting portion which rotatably supports a rotating center of the recording medium; a de-curl roller supporting portion into which the de-curl roller is movably inserted; and an extending portion which connects the recording medium supporting portion with the de-curl roller supporting portion.

In accordance with still another aspect of the present disclosure, an image forming apparatus includes a housing; a printing unit disposed inside the housing, and having a thermal head with a heating element; and a cartridge for a recording medium in which a recording medium wound in a roll shape is rotatably installed to supply the recording medium to the printing unit so that a location of a rotating center thereof is fixed, and which is disposed to be exposed to an outside of the housing.

BRIEF DESCRIPTION OF THE DRAWINGS

These and/or other aspects and advantages will become apparent and more readily appreciated from the following description of the embodiments, taken in conjunction with the accompanying drawings of which:

FIG. 10 is a cross-sectional view illustrating a state in which the de-curl roller illustrated in FIG. 8 does not interfere with the recording medium when the image forming apparatus stands by;

DETAILED DESCRIPTION

Figure 1:
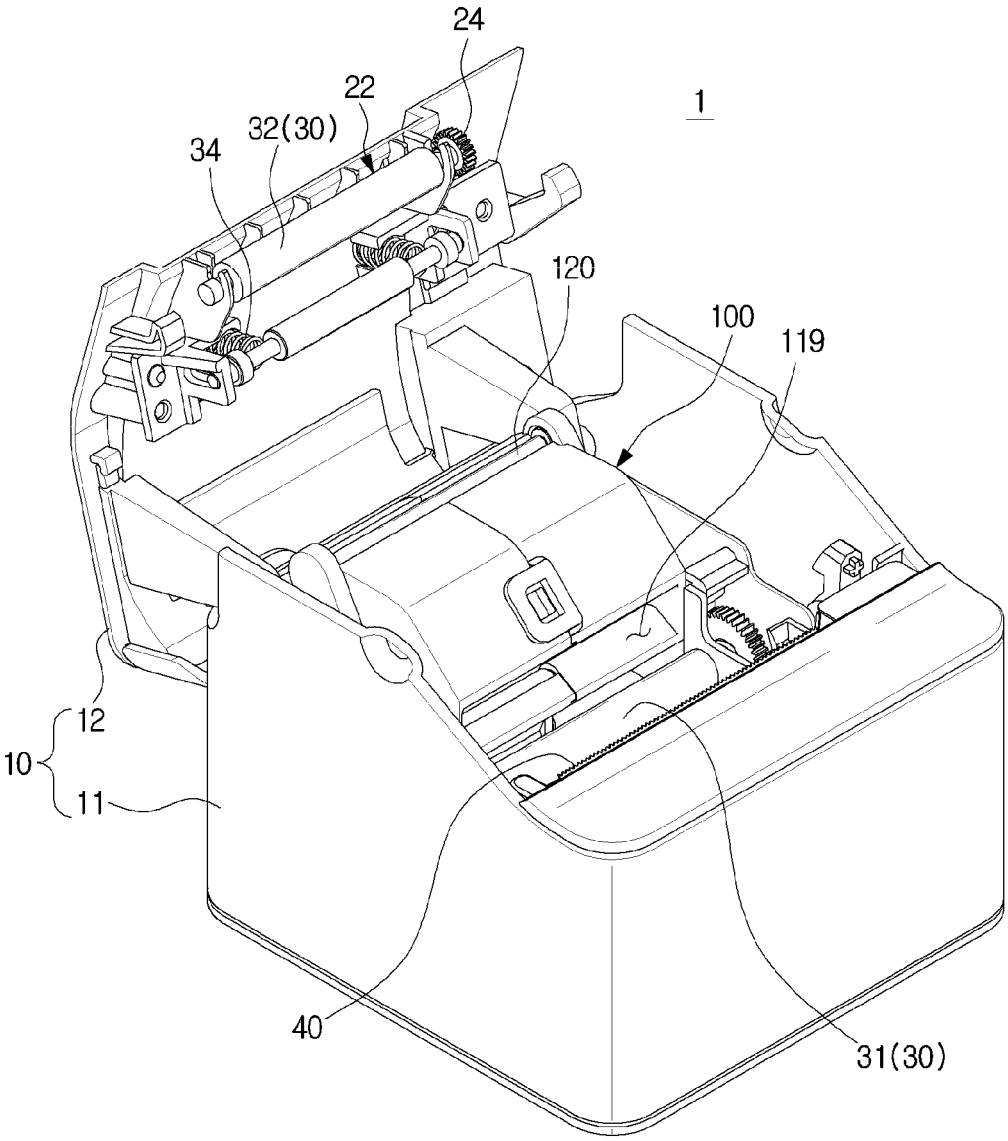
FIG. 1 is a perspective view illustrating an outer appearance of an image forming apparatus according to an embodiment of the present disclosure.

Reference will now be made in detail to the embodiments, examples of which are illustrated in the accompanying drawings, wherein like reference numerals refer to the like elements throughout. The embodiments are described below to explain the present invention by referring to the figures.

The descriptions proposed herein are just preferred examples for the purpose of illustration only so it should be understood that other equivalents and modifications could be made thereto without departing from the spirit and scope of the disclosure.

Also, like reference numerals or symbols provided in each of the drawings indicate components or elements performing the same functions.

Also, the terms used herein are merely to describe a specific embodiment, and do not limit the present disclosure. Further, unless the context clearly indicates otherwise, singular expressions should be interpreted to include plural expressions. It should be understood that the terms "comprises," "comprising," "includes" or "has" are intended to indicate the presence of features, numerals, steps, operations, elements and components described in the specification or the presence of combinations of these, and do not preclude the presence of one or more other features, numerals, steps, operations, elements and components, the presence of combinations of these, or additional possibilities.

Also, the terms including ordinal numbers such as "first," "second," etc. can be used to describe various components, but the components are not limited by those terms. The terms are used merely for the purpose of distinguishing one component from another. For example, a first component may be referred to a second component, and similarly, a second component may be referred to a first component without departing from the scope of rights of the disclosure. The term "and/or" encompasses combinations of a plurality of items or any one of the plurality of items.

Meanwhile, the terms "front end," "rear end," "upper portion," "lower portion," "upper end" and "lower end" used in the following description are defined based on the drawing, but a shape and a location of each element are not limited by those terms.

Hereinafter, exemplary embodiments according to the present disclosure will be described in detail with reference to the accompanying drawings. In the following embodiments, a recording medium is paper, particularly, adhesive paper. However, the present disclosure is not limited thereto, and common paper may also be used in an image forming apparatus according to the embodiments of the present disclosure.

Figure 2:
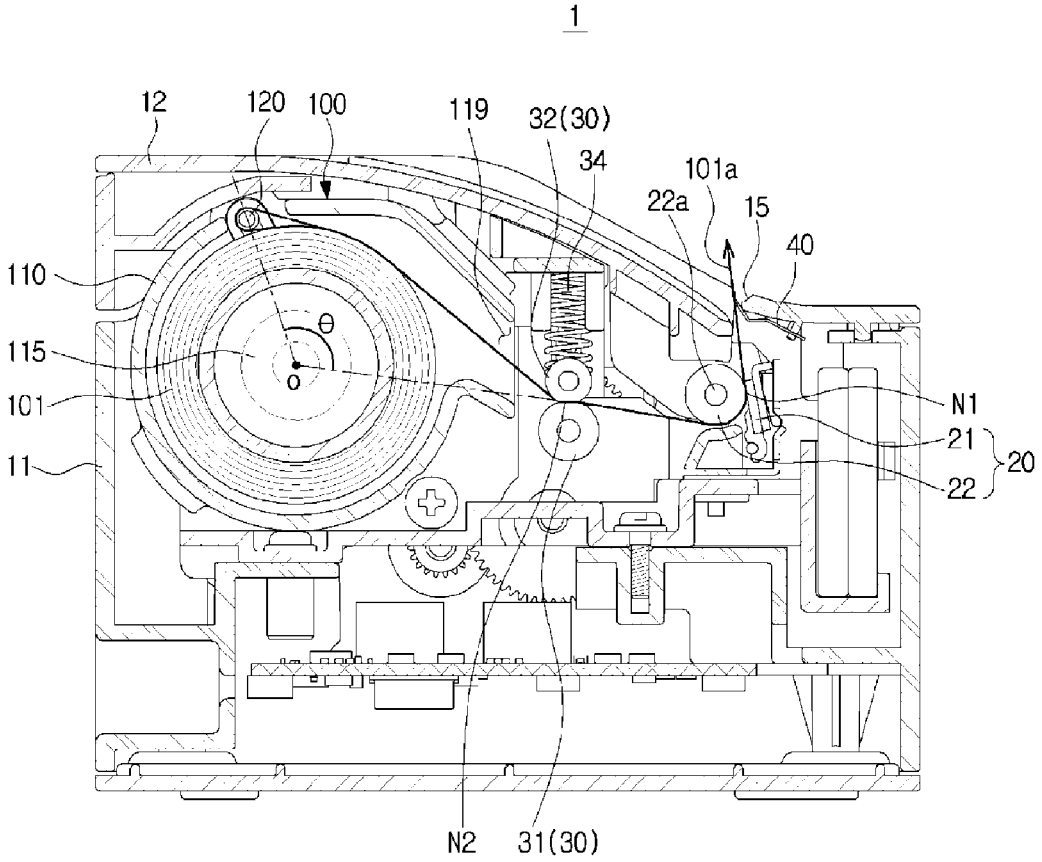
FIG. 2 is a side cross-sectional view illustrating a schematic structure of the image forming apparatus of FIG. 1.

FIG. 1 is a perspective view illustrating an outer appearance of an image forming apparatus according to an embodiment of the present disclosure. FIG. 2 is a side cross-sectional view illustrating a schematic structure of the image forming apparatus, for example, of FIG. 1.

A configuration of the image forming apparatus according to an embodiment of the present disclosure is described with reference to FIGS. 1 and 2.

As illustrated in FIGS. 1-2, an image forming apparatus 1 may include a housing 10, a printing unit 20 disposed inside the housing 10 to perform a printing operation, and a cartridge 100 for a recording medium, which is disposed inside the housing 10 and in which a recording medium 101 may be installed in a wound state.

The housing 10 may have an approximate box shape. The housing 10 may be formed by coupling a lower housing 11 and an upper housing 12. The lower housing 11 may have an approximate box shape of which an upper surface is opened, and the upper housing 12 may be provided to cover the opened upper surface of the lower housing 11.

The upper housing 12 may be rotatably hinge-coupled to one side of the lower housing 11 to open and close the upper surface of the lower housing 11. When the cartridge 100 for a recording medium is installed inside the housing 11, or a component in the housing 10 is replaced or repaired, the upper housing 12 may be rotated in one direction with respect to the lower housing 11 so that the upper surface of the lower housing 11 is opened. When the operation is completed, the upper housing 12 may be rotated in a direction opposite to the above-described one direction with respect to the lower housing 11, and thus the upper surface of the lower housing 11 may be closed.

Alternatively, the lower housing 11 and the upper housing 12 may be couplable and separable. That is, the lower housing 11 and the upper housing 12 may have an elastic coupling protrusion and a coupling groove, respectively, and may be coupled to be separable by inserting the elastic coupling protrusion into the coupling groove.

Alternatively, the lower housing 11 and the upper housing 12 may be couplable and separable using a separate fastening member such as a screw, a bolt, a pin and a rivet.

An outlet 15 through which the recording medium 101 may be discharged to the outside of the housing 10 may be formed at an upper surface of the housing 10. The outlet 15 may be formed at a boundary between the lower housing 11 and the upper housing 12. The outlet 15 may be formed by spacing apart one end of the upper housing 12 opposite to the other end thereof, to which the lower housing 11 is hinge-coupled, from one end of the lower housing 11 provided adjacent to the other end of the upper housing 12. The outlet 15 may be formed at a side surface of the lower housing 11.

The housing 10 may include a cartridge accommodating portion 16 in which the cartridge 100 for a recording medium is accommodated. The cartridge accommodating portion 16 is described below in detail together with a cartridge fixing portion 116.

The printing unit 20 includes a thermal head 21 for forming an image on the recording medium 101, and a platen roller 22 having a printing nip N1 formed between the thermal head 21 and the platen roller 22 and supporting the recording medium 101 passing through the printing nip N1.

The thermal head 21 forms an image on the recording medium 101 by applying heat to the recording medium 101 passing through the printing nip N1. The thermal head 21 has a plurality of heating elements, and may selectively heat a part of the plurality of heating elements. The plurality of heating elements may include a plurality of heating resistors, an electrode for heating the heating resistors, and a protective layer for protecting the heating resistors and the electrode.

When the thermal head 21 generates heat, the recording medium 101 may form a color in response to the heat. For example, only a portion of the recording medium 101 which receives the heat by the thermal head 21 may be changed into a black color. The recording medium may include a thermal layer 103.

The platen roller 22 may convey the recording medium 101, may be pressed to the thermal head 21 while the recording medium 101 is interposed therebetween, and thus may support the recording medium 101. The platen roller 22 may be in close contact with the thermal head 21 while the recording medium 101 is interposed therebetween. The platen roller 22 receives a driving force from a conveying motor (not shown), and rotates about a rotating shaft 22*a*. A power transmission unit 24 for power transmission may be provided between the platen roller 22 and the conveying motor. The power transmission unit 24 may be provided at each of both ends of the platen roller 22. The platen roller 22 may convey the recording medium 101. The platen roller 22 may have a cylindrical shape.

The thermal head 21 may be provided at the lower housing 11, and the platen roller 22 may be provided at the upper housing 12. the conveying motor may be provided at the lower housing 11. According an exemplary configuration, a user may open the upper housing 12, may install the cartridge 100 for a recording medium in the cartridge accommodating portion 16, then may close the upper housing 12 while a part of the recording medium 101 is located above the thermal head 21, and thus may locate the recording medium 101 between the thermal head 21 and the platen roller 22. By closing the upper housing 12, the platen roller 22 may come into contact with the thermal head 21 while the recording medium 101 is interposed therebetween, and thus may form the printing nip N1. Further, by closing the upper housing 12, the power transmission unit 24 provided at each of both ends of the platen roller 22 may be connected to the conveying motor, and thus may receive power from the conveying motor.

Figure 3:
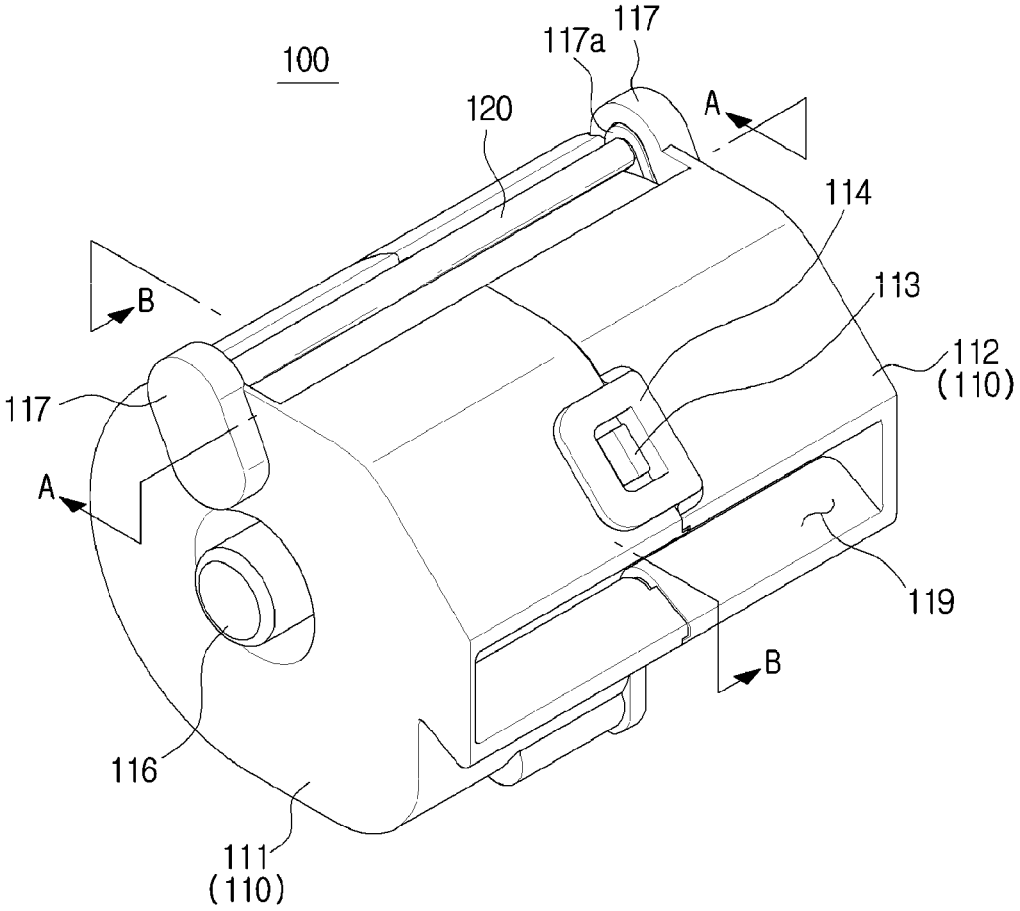
FIG. 3 is a perspective view illustrating a cartridge for a recording medium of the image forming apparatus of FIG. 1.
Figure 4:
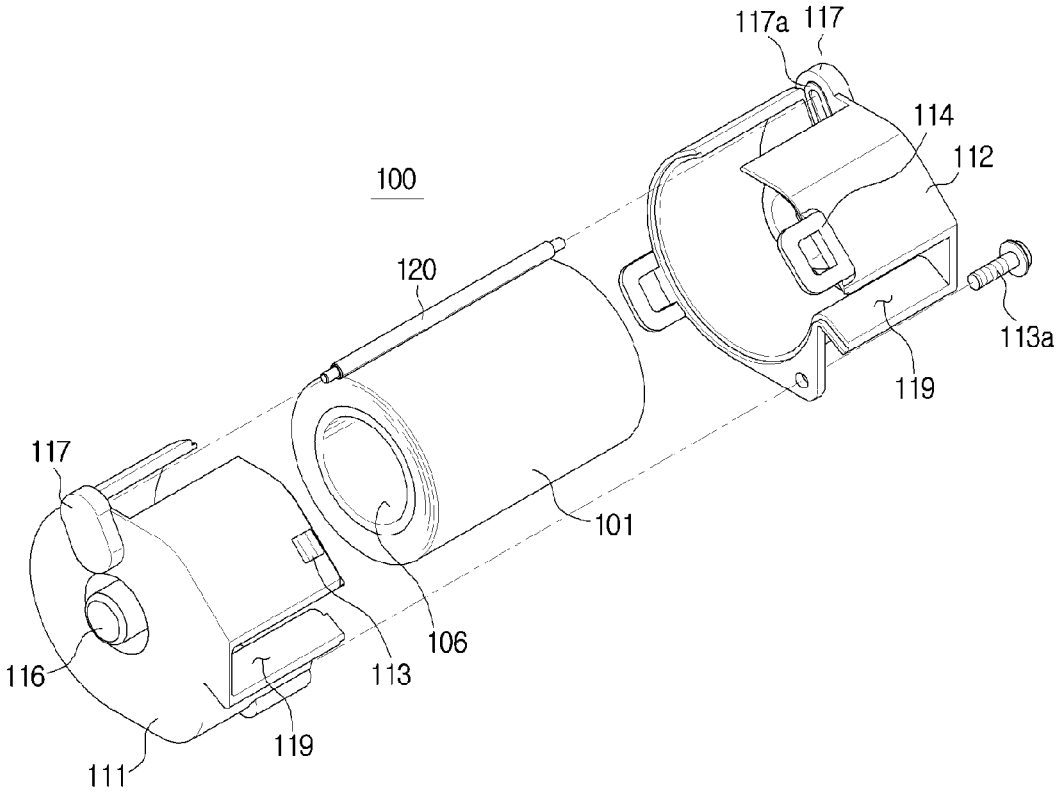
FIG. 4 is an exploded perspective view illustrating a state in which the cartridge for a recording medium of FIG. 3 is disassembled.
Figure 5:
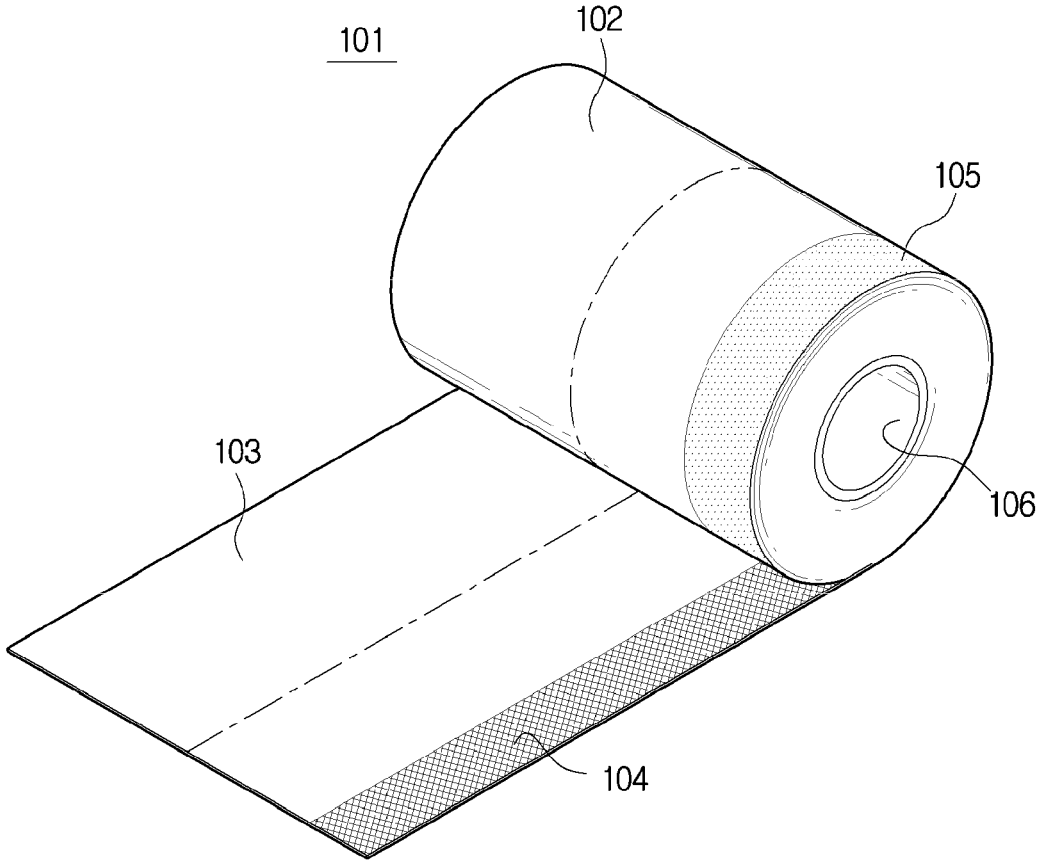
FIG. 5 is a view illustrating a state in which the recording medium of FIG. 2 is wound in a roll shape.
Figure 6:
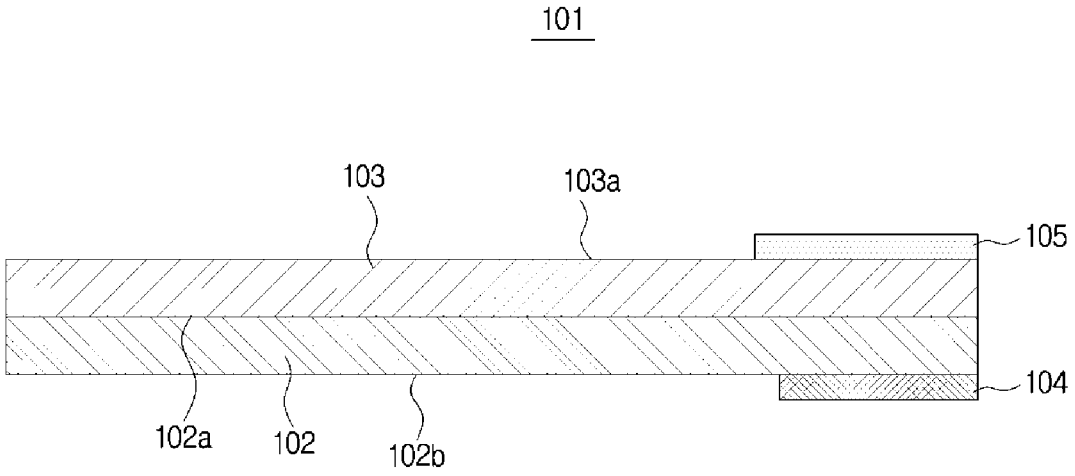
FIG. 6 is a cross-sectional view of the recording medium of FIG. 5.
Figure 7:
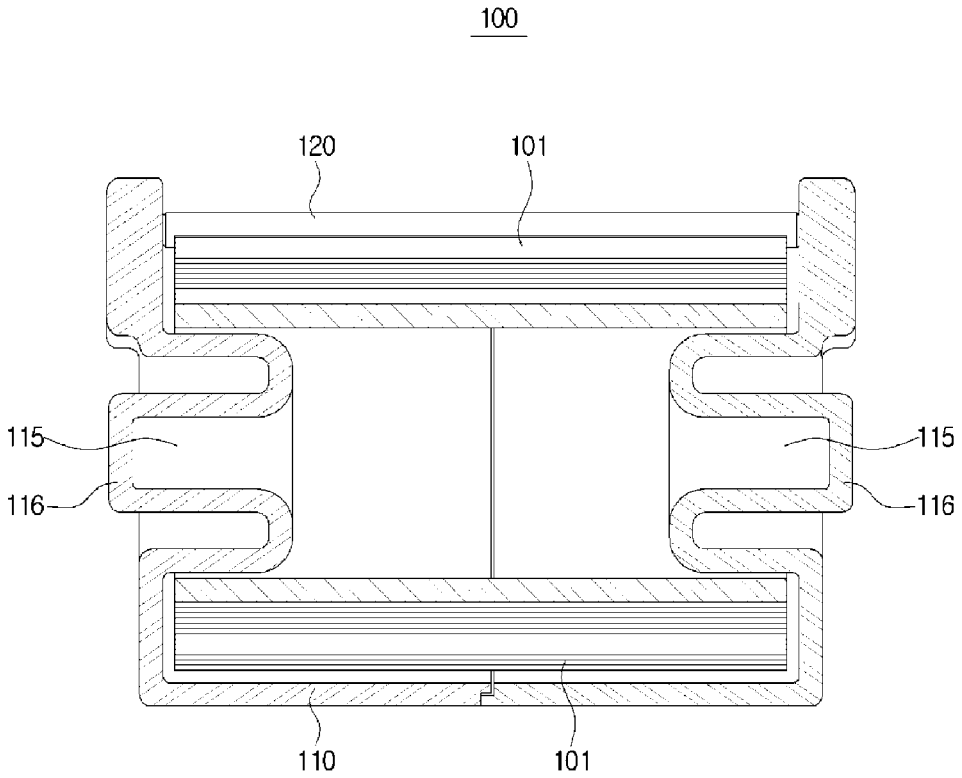
FIG. 7 is a cross-sectional view taken along line A-A' shown in FIG. 3.
Figure 8:
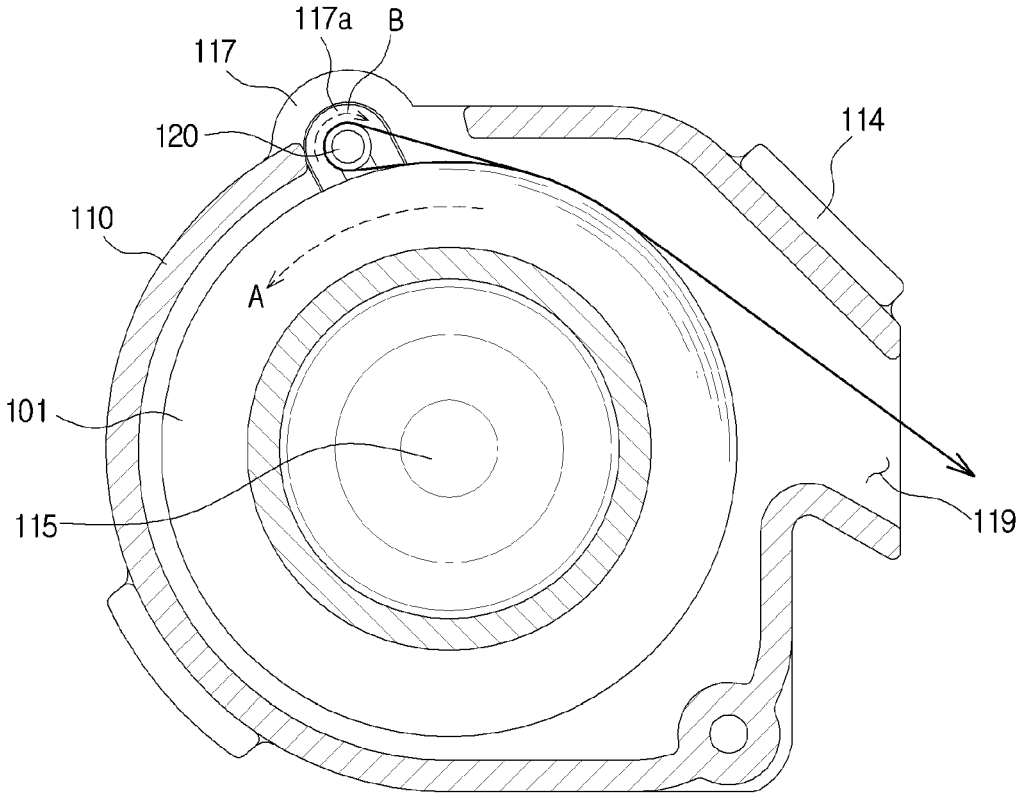
FIG. 8 is a cross-sectional view taken along line B-B' shown in FIG. 3.
Figure 9:
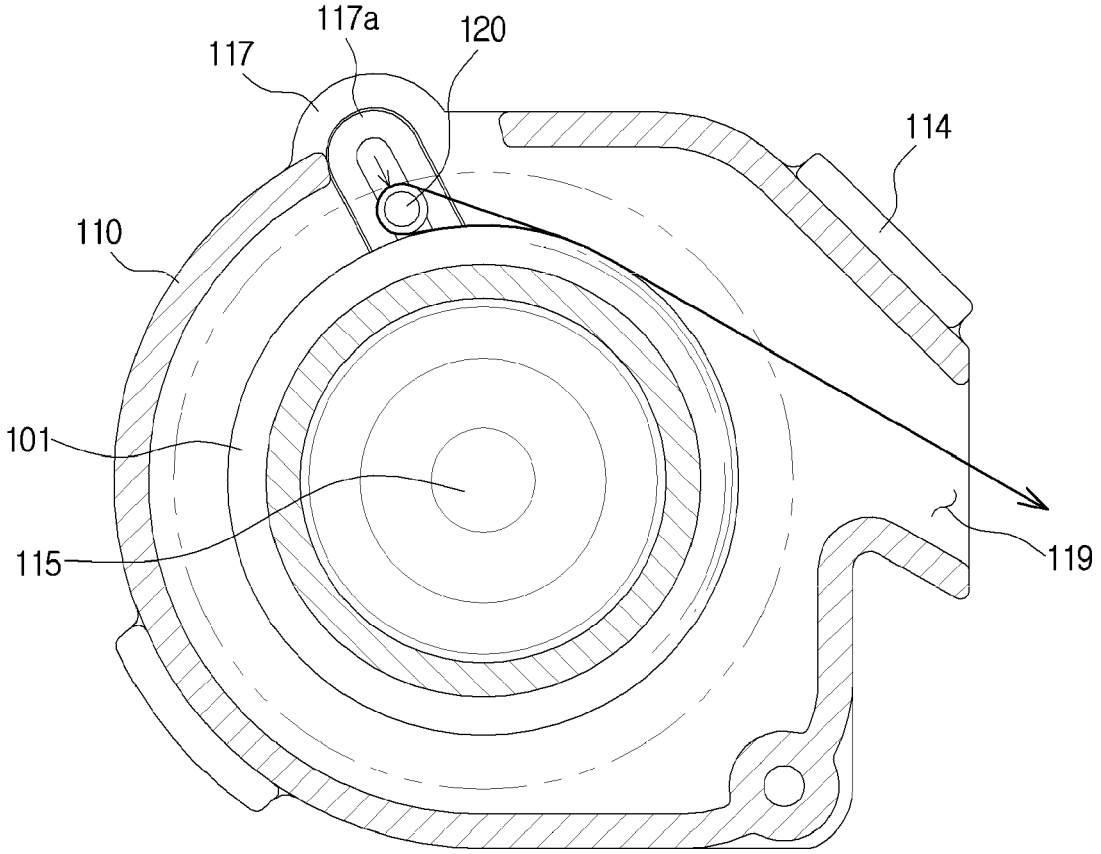
FIG. 9 is a cross-sectional view illustrating a state in which a location of a de-curl roller illustrated in FIG. 8 is moved by the recording medium when the image forming apparatus is operated.
Figure 10:
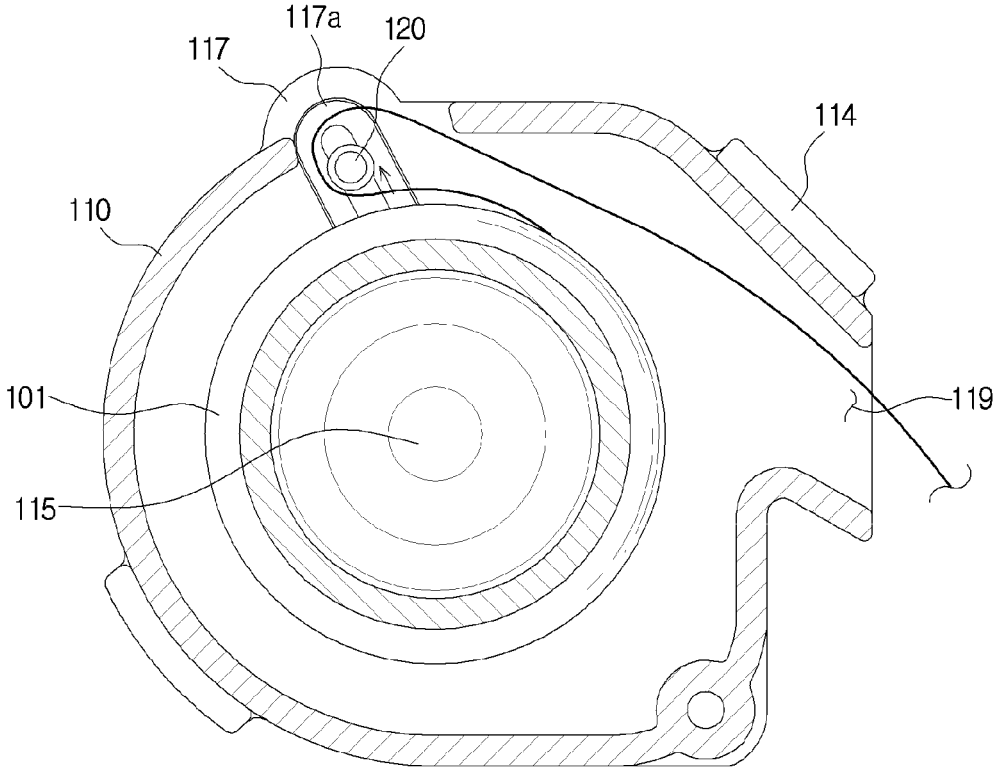
Figure 11:
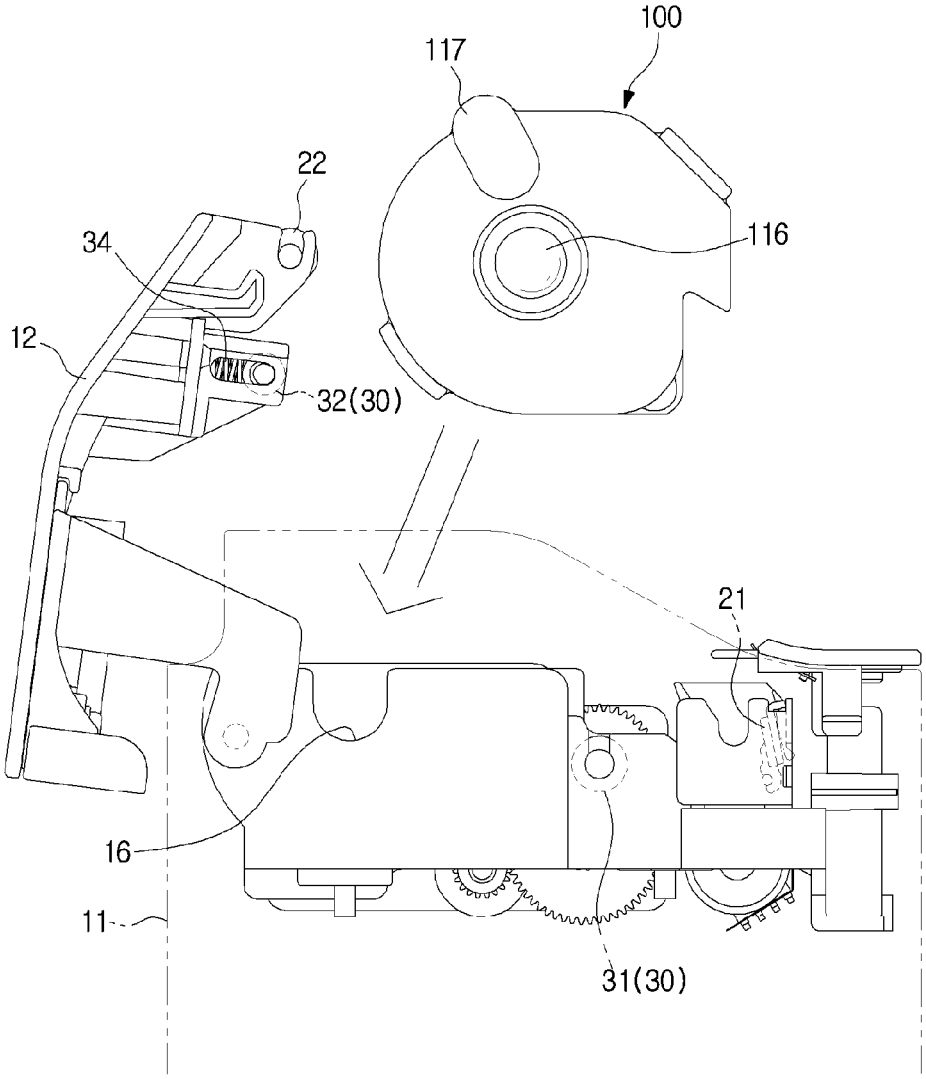
FIGS. 11 and 12 are views illustrating a process in which the cartridge for a recording medium illustrated in FIG. 1 is installed in a housing.
Figure 12:
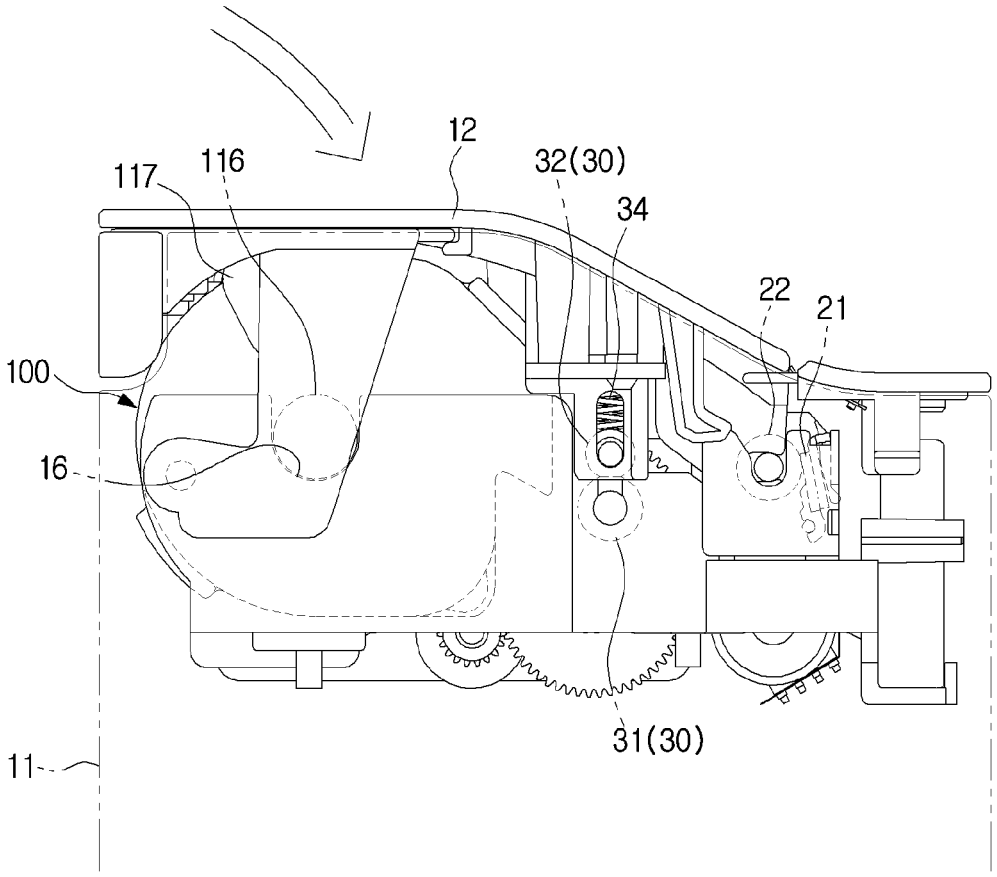
Figure 13:
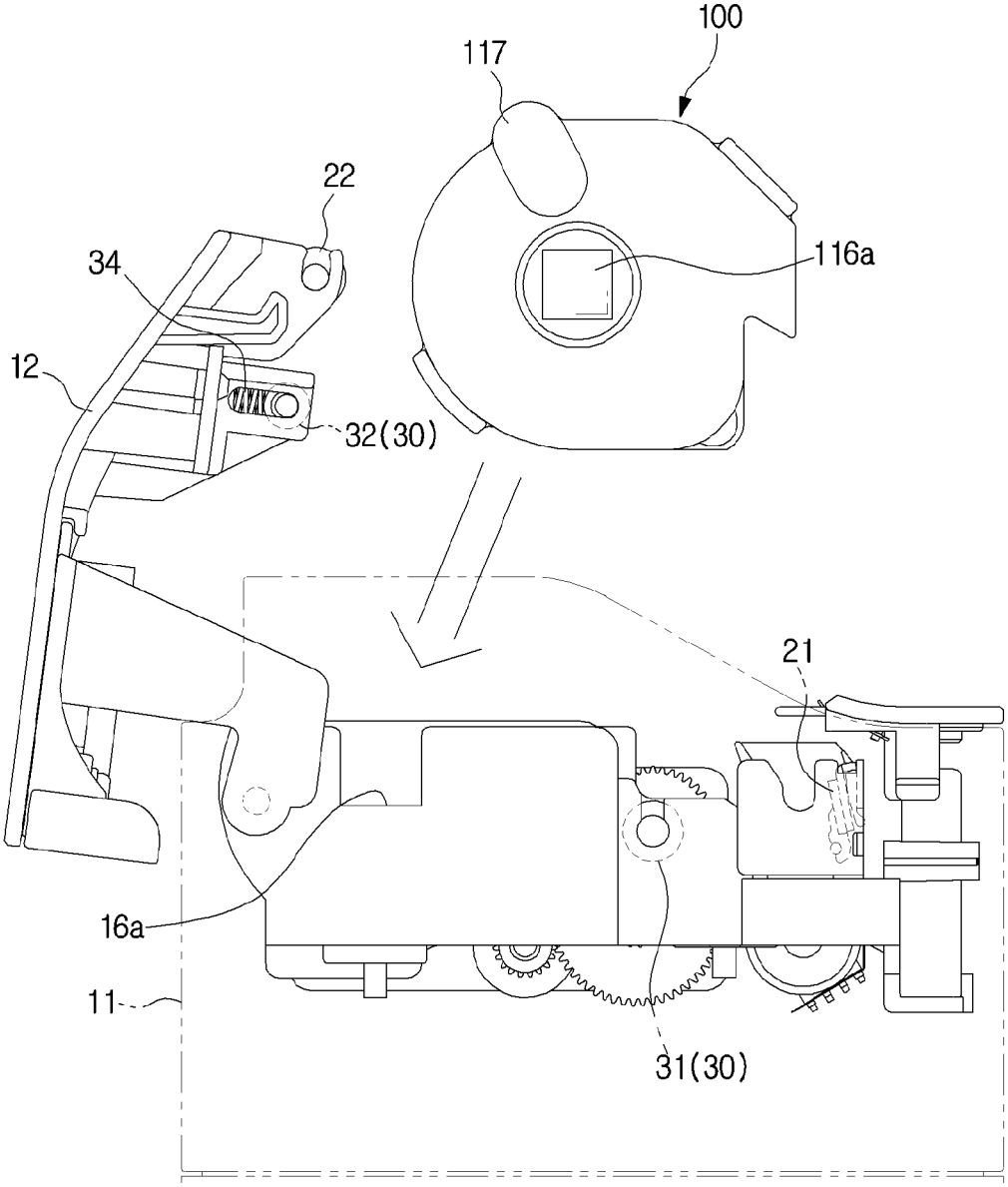
FIG. 13 is a view illustrating a modified embodiment of a recording medium supporter of the cartridge for a recording medium illustrated in FIG. 11.

FIG. 3 is a perspective view illustrating the cartridge for a recording medium of the image forming apparatus of FIG. 1. FIG. 4 is an exploded perspective view illustrating a state in which the cartridge for a recording medium of FIG. 3 is disassembled. FIG. 5 is a view illustrating a state in which the recording medium of FIG. 2 is wound in a roll shape. FIG. 6 is a cross-sectional view of the recording medium of FIG. 5. FIG. 7 is cross-sectional view taken along line A-A' shown in FIG. 3. FIG. 8 is a cross-sectional view taken along line B-B' shown in FIG. 3. FIG. 9 is a cross-sectional view illustrating a state in which a location of a de-curl roller illustrated in FIG. 8 is moved by the recording medium when the image forming apparatus is operated. FIG. 10 is a cross-sectional view illustrating a state in which the de-curl roller illustrated in FIG. 8 does not interfere with the recording medium when the image forming apparatus stands by. FIGS. 11 and 12 are views illustrating a process in which the cartridge for a recording medium illustrated in FIG. 1 is installed in a housing. FIG. 13 is a view illustrating a modified embodiment of a recording medium supporter of the cartridge for a recording medium illustrated in FIG. 11.

Referring to FIGS. 3 to 13, the cartridge 100 for a recording medium has the recording medium 101 rotatably installed therein, and may include a cartridge case 110, and a de-curl roller 120.

The recording medium 101 may be installed in the cartridge 100 for a recording medium while being continuously wound in a roll shape. The recording medium 101 wound in the roll shape may be continuously conveyed to the printing unit 20 of the image forming apparatus 1 while being released from a roll.

Referring to FIGS. 5 and 6, the recording medium 101 may include a substrate 102, the thermal layer 103 provided on a front surface 102*a* of the substrate 102, an adhesive layer 104 provided on a rear surface 102*b* of the substrate 102, and a release layer 105 provided on a front surface 103*a* of the thermal layer 103.

The substrate 102 is a base material and may be various types of paper, plastic or the like. The substrate 102 may be wound in the roll shape.

The thermal layer 103 may be formed by coating the front surface 102*a* of the substrate 102 with a heat sensitizing agent. The thermal layer 103 may be provided on an entire area of the front surface 102*a* of the substrate 102. Therefore, a printing operation may be performed on an entire area of the recording medium 101 by a thermal type image forming apparatus 1.

The adhesive layer 104 may be formed by coating the rear surface 102*b* of the substrate 102 with an adhesive. The adhesive layer 104 may have an adhesive force so that the recording medium 101 may be attached to a necessary location. The adhesive layer 104 may have an appropriate re-adhesion force so that the attached recording medium 101 may be detached and then attached again.

The adhesive layer 104 may be provided on only a partial area of the rear surface 102*b* of the substrate 102. Alternatively, the adhesive layer 104 may be provided on an entire area of the rear surface 102*b* of the substrate 102. The adhesive layer 104 may be provided at only one side of the substrate 102 based on a central line in a lengthwise direction thereof, or may be provided at both sides thereof.

The release layer 105 may be formed by coating the front surface 103*a* of the thermal layer 103 with a releasing agent. The release layer 105 may prevent a phenomenon in which a front surface of the recording medium 101 is attached to a rear surface thereof by the adhesive layer 104 while the recording medium 101 is wound in the roll shape, and may also allow the front surface of the recording medium 101 to be easily separated from the rear surface thereof when the recording medium 101 is released. The release layer 105 may be formed of the releasing agent such as a silicon resin, polyvinyl alcohol, paraffin and a wax.

The release layer 105 may be provided to correspond to an area on which the adhesive layer 104 is provided. When the adhesive layer 104 is provided on only the partial area of the rear surface 102*b* of the substrate 102, the release layer 105 may be provided on only a partial area of the substrate 102. However, when the adhesive layer 104 is provided on the entire area of the rear surface 102*b* of the substrate 102, the release layer 105 may be provided on the entire area of the substrate 102.

A width of the release layer 105 may be provided wider than that of the adhesive layer 104 to prevent the adhesive layer 104 from being deviated from the release layer 105 even when an alignment error or the like occurs while the recording medium 101 is wound in the roll shape.

Referring to FIG. 4, the recording medium 101 may be rotatably installed inside the cartridge case 110, and a cartridge opening 119 for providing the recording medium 101 to the printing unit 20 is provided at one side thereof. The cartridge case 110 is formed to surround the recording medium 101. The cartridge case 110 is provided so that a first cartridge case 111 and a second cartridge case 112 are coupled to be separable.

A cartridge hooking protrusion 113 may be provided at the first cartridge case 111, a cartridge catching groove 114 is provided at the second cartridge case 112, and thus the first cartridge case 111 and the second cartridge case 112 may be coupled to be separable by hook-coupling the cartridge hooking protrusion 113 to the cartridge catching groove 114. However, a method of separably coupling the first cartridge case 111 and the second cartridge case 112 is not limited thereto, and the first cartridge case 111 and the second cartridge case 112 may be coupled to be separable through fastening of a screw 113*a*.

Each of the first cartridge case 111 and the second cartridge case 112 may include a recording medium supporting portion 115 for fixing a location of the recording medium 101 and rotatably supporting the recording medium 101. The recording medium supporting portion 115 may be formed on an inner side surface of each of the first cartridge case 111 and the second cartridge case 112, and may fix a rotating center O (see, for example, FIG. 2) of the recording medium 101.

The recording medium supporting portion 115 may have a cylindrical shape and protrudes from the inner side surface of each of the first cartridge case 111 and the second cartridge case 112, and thus both ends of a rotating center hole 106 of the recording medium 101 may be rotatably supported by the recording medium supporting portion 115. However, a shape of the recording medium supporting portion 115 is not limited thereto. A cylindrical shaft may be provided at the rotating center O of the recording medium 101 and may protrude by a preset length in a width direction of the recording medium 101, and the recording medium supporting portion 115 may have an accommodation groove in which both ends of the cylindrical shaft are rotatably accommodated to rotatably support the recording medium 101.

The recording medium supporting portion 115 may fix a location of the rotating center O of the recording medium 101 and may prevent the location of the rotating center O of the recording medium 101 from being changed even when the recording medium 101 is consumed, and thus a radius of the wound recording medium 101 is reduced.

In a case of the recording medium 101 having the adhesive force, since the adhesive layer 104 may not be substantially evenly coated on the entire rear surface of the substrate 102, the front surface and the rear surface of the recording medium 101 are not separated at the same time in the width direction of the recording medium 101. Due to such a phenomenon, the recording medium 101 may be conveyed in a distorted state. However, since the recording medium supporting portion 115 of the image forming apparatus 1 according to an embodiment of the present disclosure may prevent a rotating axis of the recording medium 101 from being distorted, the recording medium 101 may be supplied to the printing unit 20 in a constant direction. Accordingly, the image forming apparatus 1 according to an embodiment of the present disclosure may prevent problems that an image formed on the recording medium 101 is distorted or the recording medium 101 is supplied diagonally with respect to an original supplying direction of the recording medium 101 and thus damaged.

Each of the first cartridge case 111 and the second cartridge case 112 may include a de-curl roller guiding portion 117 to which the de-curl roller 120 is slidably coupled. The de-curl roller guiding portion 117 may have a groove shape into which each of both ends of the de-curl roller 120 is slidably inserted, may be formed to be spaced apart a predetermined distance from the recording medium supporting portion 115, and may extend in a preset length in an approximately radial direction of the wound recording medium 101. The de-curl roller guiding portion 117 may guide the de-curl roller 120 to be moved toward the rotating center O of the recording medium 101.

The de-curl roller guiding portion 117 may include a bush 117*a* for fixing the de-curl roller 120, supporting a weight of the de-curl roller 120 itself and a load applied to the de-curl roller 120, and allowing the de-curl roller 120 to be slidably driven.

Also, referring to FIG. 2, the de-curl roller guiding portion 117 may be formed so that an angle θ between the de-curl roller guiding portion 117 and a conveying nip N2, which will be described below, based on the rotating center O of the recording medium 101 is 90° or more and 140° or less. When the angle θ between the de-curl roller guiding portion 117 and the conveying nip N2 based on the rotating center O of the recording medium 101 is less than 90°, a force for releasing a curl applied to the recording medium 101 is small, and thus a de-curl effect of the de-curl roller 120 is not satisfied, and when the angle θ between the de-curl roller guiding portion 117 and the conveying nip N2 based on the rotating center O of the recording medium 101 is more than 140°, the force for releasing the curl applied to the recording medium 101 is excessively increased, and thus a load is excessively generated in a system.

Also, although not illustrated, the de-curl roller guiding portion 117 may be formed so that the angle θ between the de-curl roller guiding portion 117 and the conveying nip N2 based on the rotating center O of the recording medium 101 is 220° or more and 270° or less. That is, the de-curl roller guiding portion 117 may be formed at a left lower end of the recording medium 101 rather than a left upper end thereof.

When the recording medium 101 is consumed and the radius of the wound recording medium 101 is reduced, the de-curl roller guiding portion 117 may guide the de-curl roller 120 to be moved in a direction adjacent to the recording medium 101 and may thus prevent the de-curl effect of the de-curl roller 120 from being reduced.

Referring to FIGS. 10 and 11, each of the first cartridge case 111 and the second cartridge case 112 may include a cartridge fixing portion 116 for fixing the cartridge 100 for a recording medium to the housing 10.

The cartridge fixing portion 116 may be formed in a cylindrical shape to protrude from the outside of each of the first cartridge case 111 and the second cartridge case 112 by a preset length. In response, the cartridge accommodating portion 16 of the housing 10 may have a groove shape corresponding to a cross section of the cartridge fixing portion 116 to accommodate the cartridge fixing portion 116. Therefore, the cartridge 100 for a recording medium may be fixed to and installed in the housing 10. However, a shape of each of the cartridge fixing portion 116 and the cartridge accommodating portion 16 is not limited thereto. The cartridge accommodating portion 16 may have a protrusion shape, and the cartridge fixing portion 116 may have a groove shape corresponding to the cartridge accommodating portion 16.

Since the cartridge 100 for a recording medium is coupled and fixed to the housing 10 by the cartridge fixing portion 116, the cartridge 100 for a recording medium may supply the recording medium 101 to the printing unit 20 in a constant direction. Accordingly, the image forming apparatus 1 according to an embodiment of the present disclosure may prevent the problem that the image formed on the recording medium 101 is distorted or the recording medium 101 is supplied diagonally with respect to the original supplying direction of the recording medium 101 and thus damaged.

Also, referring to FIG. 13, the cartridge fixing portion 116*a* may be formed to protrude in a square pillar shape. Therefore, the cartridge accommodating portion 16*a* may be provided to correspond to a shape of a cross section of the cartridge fixing portion 116*a*. Since the cartridge fixing portion 116*a* is formed to protrude in a polyprism shape, rotation with respect to the housing 10 may be prevented, and thus the recording medium 101 may be conveyed to the printing unit 20 in the constant direction.

Due to such a configuration, the user may easily separate the cartridge 100 for a recording medium from the housing 10 and may replace the recording medium 101.

The de-curl roller 120 may include a cylindrical shaft, and both ends thereof may be rotatably and/or slidably inserted into the de-curl roller guiding portions 117 formed at the cartridge case 110 of the cartridge 100 for a recording medium. The de-curl roller 120 may be formed of a hollow cylindrical tube. The de-curl roller 120 may be formed to have an outer diameter of about 4π or less to ensure a satisfactory de-curl effect. The de-curl roller 120 may be provided adjacent to an outer circumferential surface of the recording medium 101. The de-curl roller 120 may be provided to be in contact with the outer circumferential surface of the recording medium 101.

Since the de-curl roller 120 is provided inside the cartridge 100 for a recording medium, the de-curl roller 120 may be prevented from being disposed at a location which interferes with attaching and detaching of the cartridge 100 for a recording medium.

The de-curl roller 120 may be disposed to provide a curl to the recording medium 101 in a direction opposite to a winding direction of the recording medium 101 and may relieve or release the curl of the recording medium 101. Accordingly, as flatness of the recording medium 101 conveyed to the printing unit 20 is enhanced, the image forming apparatus 1 according to an embodiment of the present disclosure may enhance print fidelity and quality and may also prevent a recording medium jam phenomenon in which the recording medium 101 is caught on the printing nip N1 or the conveying nip N2.

The de-curl roller 120 may be provided to be moved along the de-curl roller guiding portion 117 in a direction which is spaced apart from the recording medium 101 and a direction adjacent to the recording medium 101. The de-curl roller 120 may be provided to be moved along the de-curl roller guiding portion 117 in the direction adjacent to the recording medium 101 and/or the direction spaced apart from the recording medium 101 to maintain a contact state with the outer circumferential surface of the recording medium 101.

As illustrated in FIG. 8, when the wound recording medium 101 has a large radius, the de-curl roller 120 is disposed along the de-curl roller guiding portion 117 at a location which is farthest away from the recording medium 101.

Referring to FIG. 9, as the recording medium 101 is consumed and the radius of the wound recording medium 101 becomes smaller, the de-curl roller 120 is disposed adjacent to the recording medium 101 along the de-curl roller guiding portion 117. At this point, the de-curl roller 120 may be moved along the de-curl roller guiding portion 117 by the recording medium 101 conveyed by the platen roller 22 and/or a conveying unit 30. That is, the de-curl roller 120 is moved only by a force pulled toward the recording medium 101 by the recording medium 101 (i.e., a recording medium conveying force) and a weight of the recording medium 101 itself. Therefore, as illustrated in FIG. 10, as the recording medium 101 is consumed and the radius of the wound recording medium 101 becomes smaller, but conveying of the recording medium 101 is not performed, the de-curl roller 120 does not obstruct a state in which the recording medium 101 is loosely relaxed. Due to such a configuration, when an operation of the image forming apparatus 1 is not performed, the recording medium 101 may stand by in a loose state, and thus the curl may be prevented by the de-curl roller 120 from being generated in the recording medium 101 maintained in a standby state.

The image forming apparatus 1 may include the conveying unit 30.

The conveying unit 30 may include a first conveying roller 31, a second conveying roller 32 and a conveying roller driver (not shown) that allow the recording medium 101 provided from the cartridge 100 for a recording medium to be conveyed.

The first conveying roller 31 may be provided in the lower housing 11, connected to the conveying roller driver, and receive power from the conveying roller driver. The conveying roller driver may include a motor.

The second conveying roller 32 may be provided in the upper housing 12 and disposed to come into contact with the first conveying roller 31 to form the conveying nip N2 when the upper housing 12 is located to close the upper surface of the lower housing 11. Due to such a configuration, the user may install the cartridge 100 for a recording medium, in which the recording medium 101 is installed, in the cartridge accommodating portion 16 of the housing 10, then may close the upper housing 12 while a part of the recording medium 101 is located at an upper side of the first conveying roller 31, and may thus locate the recording medium 101 between the first conveying roller 31 and the second conveying roller 32. As the upper housing 12 is closed, the second conveying roller 32 may come into contact with the first conveying roller 31 while the recording medium 101 is interposed therebetween and may form the conveying nip N2. The user may perform setup so that a part of the recording medium 101 is located between the first conveying roller 31 and the second conveying roller 32, and a part of the recording medium 101 is also located between the thermal head 21 and the platen roller 22 as described above.

The second conveying roller 32 may include a pressing member 34 pressing the second conveying roller 32 toward the first conveying roller 31 to increase an area of the conveying nip N2 formed between the first conveying roller 31 and the second conveying roller 32. The pressing member 34 may include a spring having an elastic force.

The image forming apparatus 1 according to an embodiment of the present disclosure may further include a cutter 140. The continuous recording medium 101 passed through the printing unit 20 may be cut into a unit recording medium 101*a* by the cutter 40. The unit recording medium 101*a* may be discharged to the outside of the image forming apparatus 1 through the outlet 15.

Since the image forming apparatus 1 of the present disclosure supplies the recording medium 101 to the printing unit 20 through the cartridge 100 for a recording medium, a supplying direction of the recording medium 101 may be constantly maintained. Therefore, the image distortion problem and the damage problem of the recording medium 101, which may occur when the recording medium 101 is conveyed, may be prevented, and the load of the system may be prevented from being increased.

Also, in the image forming apparatus 1 of the present disclosure, the de-curl roller 120 may be provided to be movable with respect to the cartridge 100 for a recording medium and may thus prevent degradation of the de-curl effect occurring while the radius of the recording medium 101 becomes small due to consumption of the recording medium 101.

Figure 14:
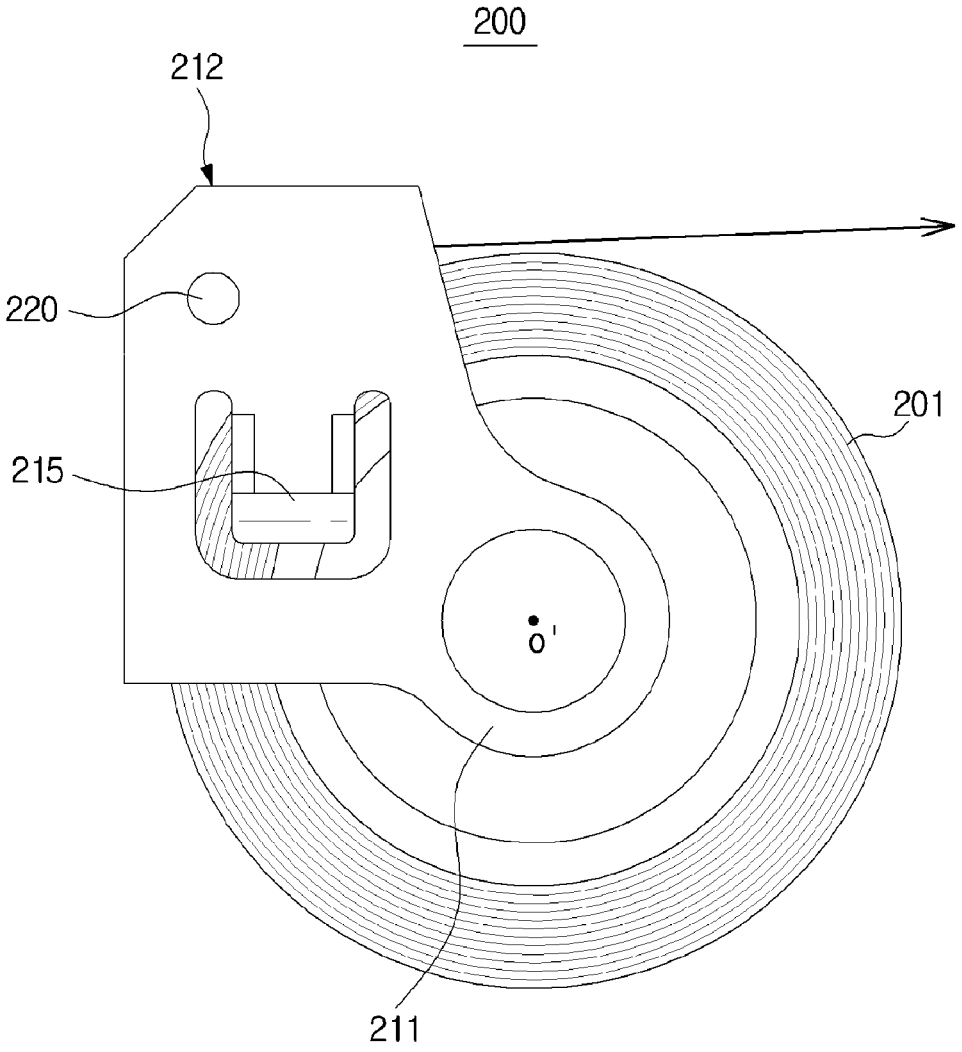
FIGS. 14 and 15 are views illustrating another embodiment of the cartridge for a recording medium illustrated in FIG. 3.
Figure 15:
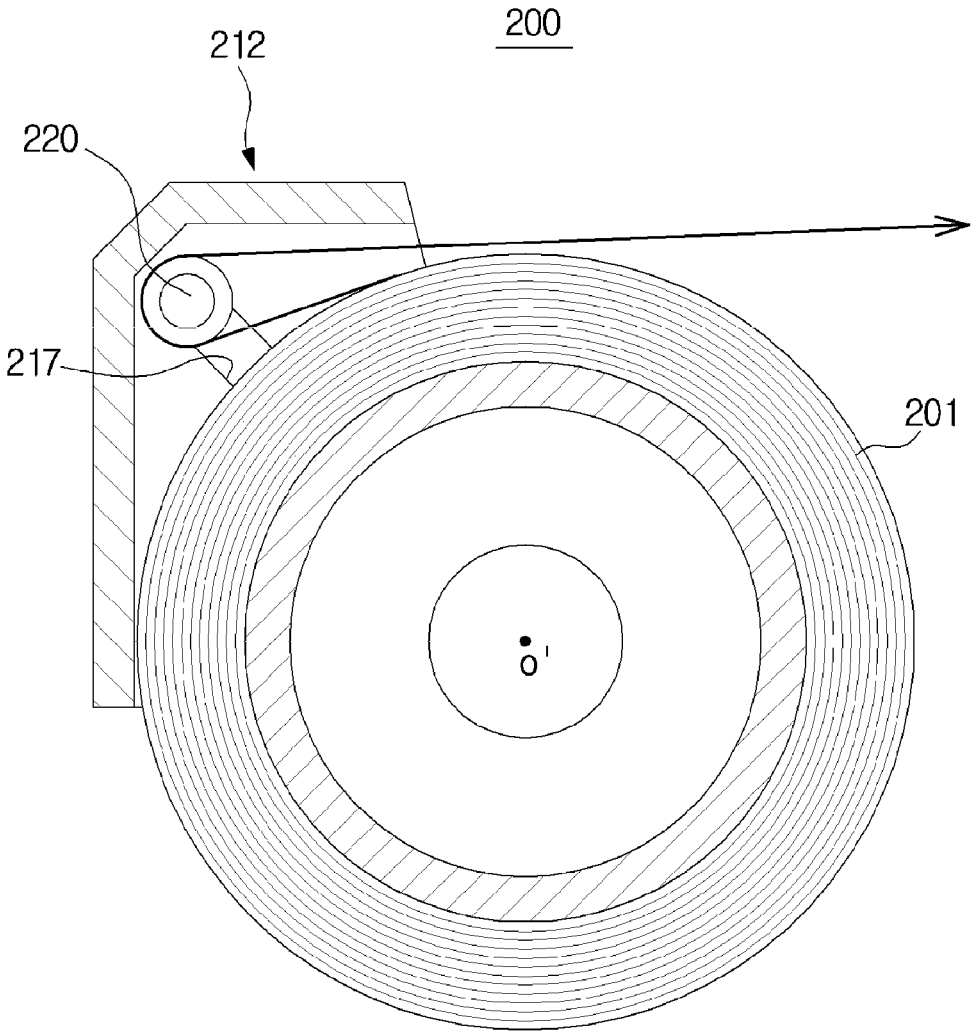

FIGS. 14 and 15 are views illustrating another embodiment of the cartridge for a recording medium illustrated in FIG. 3.

A cartridge for a recording medium of an image forming apparatus according to another embodiment of the present disclosure is described with reference to FIGS. 14 and 15. The same elements as those in the above-described embodiment are designated by the same reference numerals, and descriptions thereof will be omitted and may also be equally applied to the embodiment in the same manner.

A cartridge 200 for a recording medium according to another embodiment of the present disclosure may include a recording medium supporting portion 211 for rotatably supporting a rotating center of a recording medium 201, a de-curl roller supporting portion 212 into which a de-curl roller 220 is movably inserted, and an extending portion 213 for connecting the recording medium supporting portion 211 with the de-curl roller supporting portion 212.

The recording medium supporting portion 211 may rotatably support the rotating center O' of the recording medium 201 so that a location thereof is fixed.

A de-curl roller guiding portion 217 for slidably and/or rotatably supporting the de-curl roller 220 may be formed at the de-curl roller supporting portion 212.

The extending portion 213 may connect and support the recording medium supporting portion 211 and the de-curl roller supporting portion 212.

Due to such a configuration, a case for surrounding the entire recording medium 201 may be omitted from the cartridge 200 for a recording medium according to the embodiment illustrated in FIG. 14.

Also, referring to FIG. 14, a housing hooking groove 215 formed to be hook-coupled to the housing 10 may be formed at the extending portion 213. Therefore, the cartridge 200 for a recording medium may be hook-coupled and fixed to the housing 10.

Figure 16:
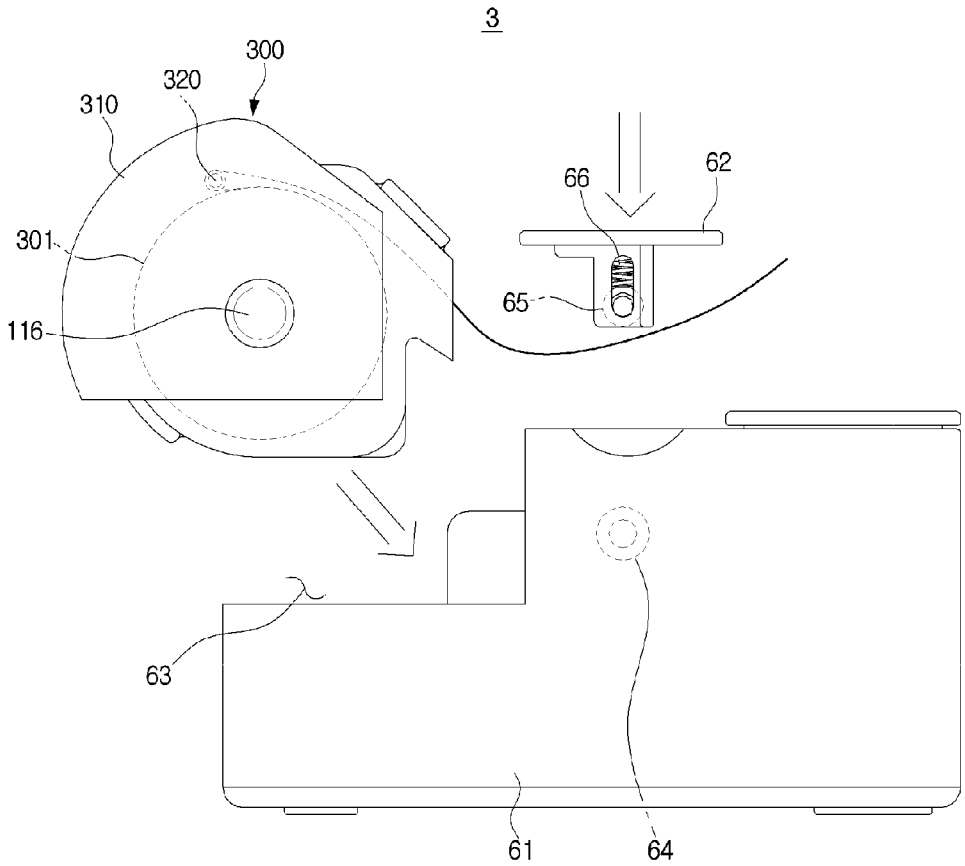
FIGS. 16 and 17 are views illustrating still another embodiment of the cartridge for a recording medium illustrated in FIG. 3.
Figure 17:
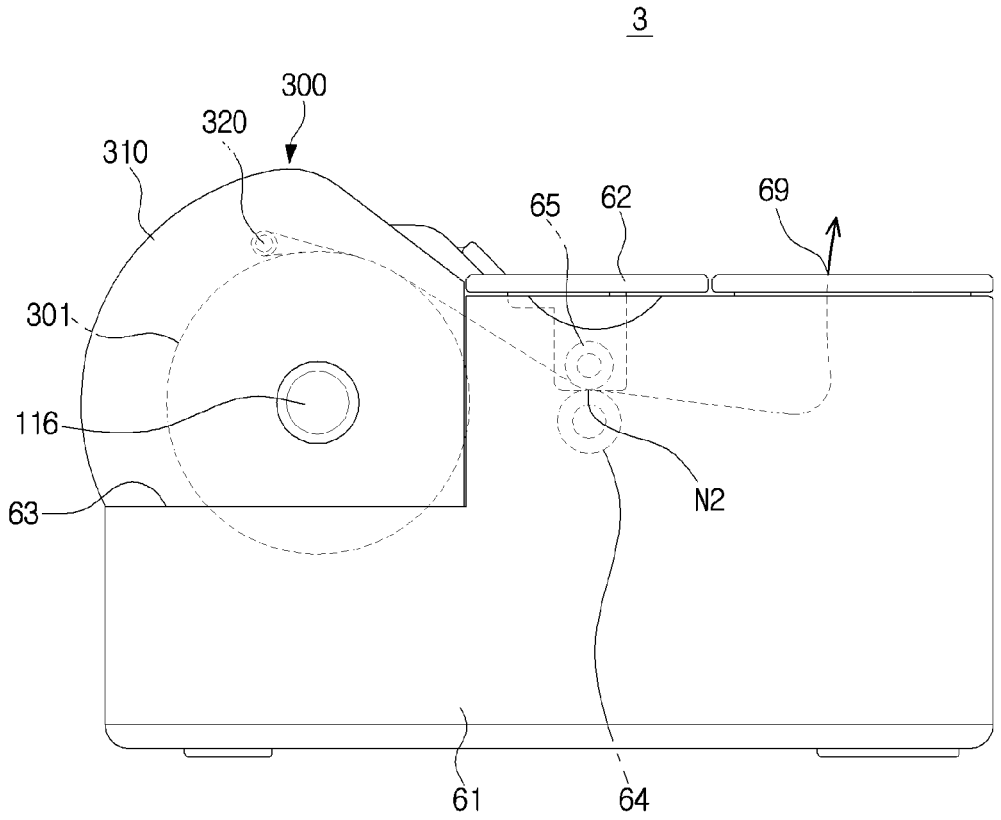

FIGS. 16 and 17 are views illustrating still another embodiment of the cartridge for a recording medium illustrated in FIG. 3.

A cartridge for a recording medium of an image forming apparatus according to still another embodiment of the present disclosure will be described with reference to FIGS. 16 and 17. The same elements as those in the above-described embodiment are designated by the same reference numerals, and descriptions thereof will be omitted and may also be equally applied to the embodiment in the same manner.

Referring to FIGS. 16 and 17, an image forming apparatus 3 may include a lower housing 61 and an upper housing 62, and a cartridge 300 for a recording medium may be installed outside the housings 61 and 62. Therefore, when the image forming apparatus 3 has an installing portion 63 of the cartridge 300 for a recording medium, a somewhat large cartridge 300 for a recording medium in which a large amount of recording medium 301 may be installed may also be applied, and thus there is an advantage in terms of compatibility of the cartridge 300 for a recording medium.

A user may open the upper housing 62 from the lower housing 61 and installs the cartridge 300 for a recording medium at the installing portion 63 and a part of the recording medium 301 may be disposed at an upper side of a first conveying roller 64. Then, the user may locate the upper housing 62 at a closing location and may thus complete an installing of the cartridge 300 for a recording medium. A second conveying roller 65 forms the conveying nip N2 between the first conveying roller 64 and the second conveying roller 65, and a pressing member 66 may be provided at a side of the second conveying roller 65 to increase the area of the conveying nip N2.

Due to such a configuration, a curl may be released or relieved by a de-curl roller 320 while the recording medium 301 is installed in a cartridge case 310, and then the recording medium 301 may be supplied to the conveying units 64 and 65.

As described above, since the image forming apparatus according to the present disclosure fixes the rotating center of the recording medium using the cartridge for a recording medium, the recording medium can be supplied in the constant direction. Therefore, the problems such as the image distortion and the damage to the recording medium can be prevented.

Also, in the image forming apparatus according to the present disclosure, since the de-curl roller is provided to be moved toward the recording medium, the de-curl effect can be constantly maintained even when the radius of the recording medium is reduced due to the consumption of the recording medium.

According to the aspect of the present disclosure, in the image forming apparatus, since the rotating center of the recording medium is rotatably coupled to the cartridge and the position of the rotating center is prevented from being changed, the recording medium can be prevented from being diagonally conveyed.

According to the aspect of the present disclosure, in the image forming apparatus, since the de-curl roller for releasing or relieving the curl of the recording medium is provided to be movable toward the rotating center of the recording medium, the de-curl roller can maintain de-curl performance even when the recording medium is consumed and a gap between an outermost portion of the recording medium and the de-curl roller is increased.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A cartridge for a recording medium, comprising:

a cartridge case including a recording medium supporting portion to rotatably fix the recording medium that is wound in a winding direction; and a de-curl roller movably coupled to the cartridge case to guide an unwound portion of the recording medium to be curved in a direction opposite to the winding direction of the recording medium, wherein the de-curl roller is movable in a direction that approaches the recording medium as a radius of a wound portion of the recording medium is reduced.

2. The cartridge according to claim 1, wherein the cartridge case comprises a de-curl roller guiding portion into which the de-curl roller is movably insertable and to guide the de-curl roller to be movable when the de-curl roller is movably inserted.

3. The cartridge according to claim 1, wherein the de-curl roller is movable in the direction that approaches the recording medium including a direction to be adjacent to the recording medium, or in another direction to be spaced apart from the recording medium to maintain a contact with an outer circumferential surface of the unwound portion of the recording medium.

4. An image forming apparatus comprising:

a housing for the image forming apparatus;

a printing unit disposed inside the housing and having a thermal head with a heating element; and a cartridge to which a recording medium wound in a winding direction is couplable and to supply an unwound portion of the coupled recording medium to the printing unit in response to unwinding of the coupled recording medium, wherein the cartridge includes a de-curl roller to be movable to guide the unwound portion of the recording medium to be curved in a direction opposite to the winding direction of the recording medium, when the cartridge supplies the unwound portion of the coupled recording medium to the printing unit, wherein the de-curl roller is movable in a direction that approaches the recording medium as a radius of a wound portion of the recording medium is reduced.

5. The image forming apparatus according to claim 4, wherein:

the housing comprises a conveying unit that conveys the unwound portion of the coupled recording medium supplied from the cartridge, and the de-curl roller is disposed so that an angle with respect to the conveying unit based on a rotating center of the coupled recording medium is 90° or more and 140° or less.

6. The image forming apparatus according to claim 4, wherein the cartridge comprises a cartridge fixing portion fixable to the housing of the image forming apparatus.

7. The image forming apparatus according to claim 6, wherein:

the housing comprises a cartridge accommodating portion into which the cartridge fixing portion is insertable.

8. The image forming apparatus according to claim 6, wherein the cartridge fixing portion comprises a housing hooking groove hook couplable to the housing.

9. The image forming apparatus according to claim 4, wherein the housing comprises:

a lower housing having a first conveying roller to convey the unwound portion of the coupled recording medium supplied from the cartridge and an upper housing to open or close an upper surface of the lower housing and including a second conveying roller to convey the unwound portion the coupled recording medium together with the first conveying roller, wherein the second conveying roller is disposed to form a conveying nip together with the first conveying roller when the upper housing closes the upper surface of the lower housing.

10. The image forming apparatus according to claim 4, wherein:

the housing comprises a lower housing, and an upper housing to open or close an upper surface of the lower housing, the printing unit comprises a platen roller to form a printing nip together with the thermal head and is provided in the upper housing, and the platen roller to form the printing nip together with the thermal head when the upper housing closes the upper surface of the lower housing.

11. The image forming apparatus according to claim 10, wherein:

the printing unit comprises a conveying motor in the lower housing to generate power for driving the platen roller, and the platen roller connectable to the conveying motor to receive the power when the upper housing closes the upper surface of the lower housing.

12. The image forming apparatus according to claim 4, wherein the cartridge comprises a de-curl roller guiding portion into which the de-curl roller is movably insertable and which is formed to guide movement of the de-curl roller.

13. The image forming apparatus according to claim 4, wherein the de-curl roller is movable in the direction that approaches the recording medium including a direction to be adjacent to the coupled recording medium or in another direction to be spaced apart from the coupled recording medium to maintain a contact with an outer circumferential surface of the unwound portion of the coupled recording medium.

14. The image forming apparatus according to claim 4, wherein the de-curl roller is to be movable in the direction that approaches the recording medium by a weight of the de-curl roller itself or by a force for conveying the coupled recording medium.

15. The image forming apparatus according to claim 4, wherein at least a part of one surface of the recording medium has an adhesive property.

16. The image forming apparatus according to claim 4, wherein the cartridge comprises a recording medium supporting portion to fix a position of a rotating center of the coupled recording medium to be rotatable.

17. The image forming apparatus according to claim 4, wherein the cartridge comprises a cartridge case to cover the recording medium and has an opening to supply the coupled recording medium to the printing unit.

18. The image forming apparatus according to claim 4, wherein the cartridge comprises:

a recording medium supporting portion to rotatably support a rotating center of the coupled recording medium, a de-curl roller supporting portion into which the de-curl roller is movably insertable, and an extending portion to connect the coupled recording medium supporting portion with the de-curl roller supporting portion.

* * * * *